United States Patent [19]

Zöllner et al.

[11] 4,456,519

[45] Jun. 26, 1984

[54] REGENERATABLE, NON-CONSUMABLE ELECTRODE FOR HIGH TEMPERATURE USES

[75] Inventors: Dieter H. Zöllner; Christine Zöllner, both of Schwaig bei Nürnberg; Inge Lauterbach-Dammler, Nüremberg; Konrad Koziol, Röthenbach a.d. Pegnitz; Malcolm F. Pilbrow, Lauf, all of Fed. Rep. of Germany

[73] Assignee: C. Conradty Nurnberg GmbH & Co., Pegnitz, Fed. Rep. of Germany

[21] Appl. No.: 169,851

[22] Filed: Jul. 17, 1980

[30] Foreign Application Priority Data

| | | | |
|---|---|---|---|
| Jul. 20, 1979 | [DE] | Fed. Rep. of Germany | 2929346 |
| Jan. 5, 1980 | [DE] | Fed. Rep. of Germany | 3000294 |
| Jun. 6, 1980 | [DE] | Fed. Rep. of Germany | 3021427 |

[51] Int. Cl.[3] ..... C25B 11/02; C25C 7/00

[52] U.S. Cl. ..... 204/290 R

[58] Field of Search ..... 204/290 R, 294, 64 T, 204/67, 70, 243 R; 75/0.5 BC, 951, 232

[56] References Cited

U.S. PATENT DOCUMENTS

| | | | |
|---|---|---|---|
| 3,403,008 | 9/1968 | Hamling | 423/251 |
| 3,796,587 | 3/1974 | Sara | 75/0.5 BC |
| 4,046,663 | 9/1977 | Fleet et al. | 204/280 |
| 4,046,664 | 9/1977 | Fleet et al. | 204/280 |
| 4,057,480 | 11/1977 | Alder | 204/290 R |
| 4,098,669 | 7/1978 | De Nora et al. | 204/252 |
| 4,155,757 | 5/1979 | Hing | 75/232 |
| 4,173,518 | 11/1979 | Yamada et al. | 204/67 |

FOREIGN PATENT DOCUMENTS

| | | | |
|---|---|---|---|
| 2446314 | 4/1975 | Fed. Rep. of Germany . | |
| 2354477 | 5/1975 | Fed. Rep. of Germany . | |
| 2757808 | 6/1978 | Fed. Rep. of Germany | 204/294 |
| 2109016 | 5/1972 | France . | |
| 2289634 | 5/1976 | France . | |
| 1152124 | 5/1969 | United Kingdom . | |

OTHER PUBLICATIONS

South Africa application Ser. No. 771,931 by Diamond, filed 4/77.

Dickson et al., J. Amer. Chem. Soc., vol. 83, pp. 3026–3029, 7/61.

*Primary Examiner*—F. Edmundson

*Attorney, Agent, or Firm*—Gifford, Van Ophem, Sheridan, Sprinkle & Nabozny

[57] ABSTRACT

The application is drawn to an electrode made of a number of elongated elements which are plates, rods or tubes. The elements are composed of inorganic conductive fibers embedded in a solid, electrochemically active material. The fibers are oriented in the direction of current flow.

20 Claims, 12 Drawing Figures

Figure 7:
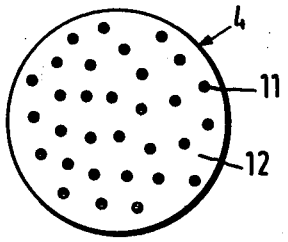

Fig.1
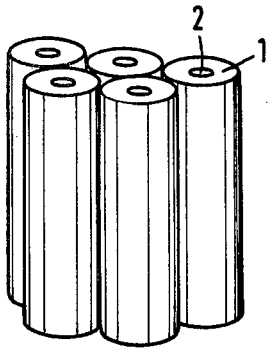
Fig.2
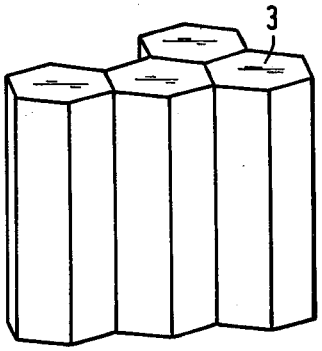
Fig.3
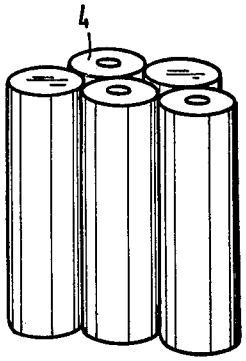
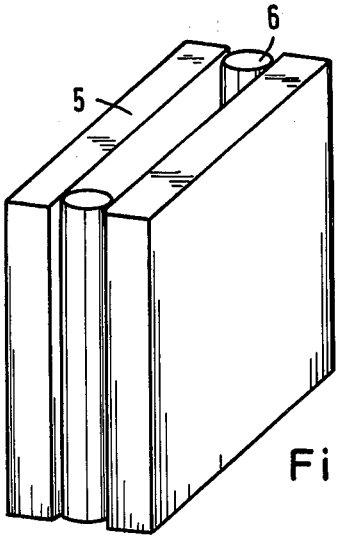
Fig.4
Fig.5
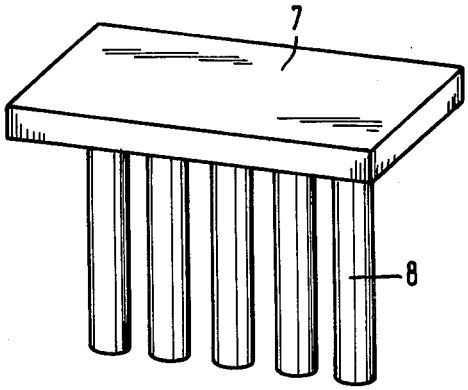
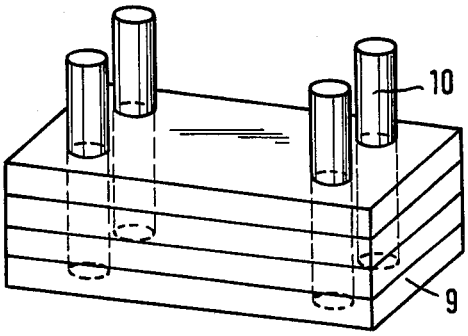
Fig.6

REGENERATABLE, NON-CONSUMABLE ELECTRODE FOR HIGH TEMPERATURE USES

The invention relates to a regeneratable, non-consumable electrode for high temperature uses, in particular for fused salt electrolysis.

Carbon electrodes of amorphous carbon or electrographite are primarily used today in the large scale electrolytic production of aluminum, magnesium, sodium, lithium and other metals as well as their compounds. These electrodes primarily serve to conduct current; furthermore, they can actively participate in electrode reactions, as in the production of aluminum. The actual electrode consumption in all cases is far above that theoretically expected, which is above all due to the susceptibility of carbon to oxydize at high temperatures. It can be presumed that, with a total yearly use of about 10 million tons carbon-electrodes, about 3 million tons are uselessly burned off by air oxidation. Attempts made to decisively lower the consumption by oxidation-inhibiting impregnation and protective coatings had only little success.

In view of the increasing costs for graphite and electrode carbon, there results a need for non-consumable electrodes exhibiting lower consumption.

A number of ceramic materials have already been suggested as electrode materials; see for example British Pat. No. 1 152 124 (primarily stabilized zirconium oxide), U.S. Pat. No. 4,057,480 (substantially tin(IV)oxide), German OS 27 57 808 (substantially silicon carbide-valve metal boride-carbon), South African Patent Application 77/1931 (yttrium oxide having surface layers of electrocatalysts) or German OS 24 46 314 (ceramic base material with a coating of spinell-compounds).

Most of the ceramic materials frequently only exhibit a moderate to average electric conductivity even after addition of conductivity increasing components. This may be tolerated when the materials are used as electrode material as long as the electrode dimensions are small, in particular when the current path is short, such as usually is the case with electrodes for aqueous electrolytes. High-temperature ceramic materials of good electrical conductivity and exhibiting the required chemical stability are rather expensive materials.

The classical high temperature electrode made of graphitic or non-graphitic carbon has in most cases the shape of a cylinder or a rectangular block, respectively of substantial dimensions; the dimensions for typical electrodes for the production of magnesium are 80×40×1800 mm; electrodes for the production of aluminum may have dimensions of up to 2250×750×950 mm. The production of such massive blocks from the ceramic materials mentioned is costly and creates considerable difficulties with regard to the stability to sudden changes in temperature and the internal electrical resistence.

Furthermore, the service life of the said ceramic materials is limited under typical fused salt electrolysis conditions on account of the high temperatures, the aggressive media that are used and the high current load. Wear-off rates of between 0.7 and 10 g per 100 h duration of electrolysis are determined in practice. In consideration of the high costs of the equipment, the intention is to increase the service life of electrodes for high-temperature applications. It is desirable even with increased service life to make it possible to regenerate the electrode, which is understood to refer to renewed application of or, respectively, coating with ceramic material.

Starting therefrom, the object of this invention is to make available a novel electrode for high temperature applications, in particular fused salt electrolysis, which electrode exhibits higher electrochemical activity, a lower electrical internal resistence as well as a longer service life, and which electrode furthermore can readily be regenerated.

This object is accomplished according to the invention by an electrode having the features set forth in claim 1. Advantageous embodiments and further developments of the electrode according to the invention result from the subclaims.

The realization of the invention is primarily based on two aspects, namely (a) the utilization of a particular electrode material; and (b) the possibility of giving a particular shape to this particular electrode material.

The electrode material provided according to the invention is a composite material of inorganic fibers which conduct electric current, and of at least one electrochemically active material.

It is typically carbon, boron, carbides such as silicon carbide, tantalum carbide or tungsten carbide as well as non-stoichiometric carbides of tantalum and niobium, optionally mixed with carbon, which come into consideration as fibrous materials. These fibrous materials may be present in monocrystalline or polycrystalline form and, on account of their high electrical conductivity, ensure a low electrical resistence over the entire length of the fiber. These fibers are to a considerable extent intended to effect uniform and good distribution of the current within the electrode and to conduct the current in the manner desired to the active surface on the outer cover layer of the fibers. Primarily high-melting, chemically stable materials that transport electric charge come into consideration as electrochemically active material, for example metal carbides, metal borides, metal nitrides and optionally also elemental metal; in this case particularly tantalum and tantalum compounds, such as tantalum carbide and tantalum oxide, furthermore certain barium titanates or selected "cermet"-materials made of two different metals and a transition metal oxide. These electrochemically active materials may be applied as a coating onto the fibers, or the fibers may be embedded within an embedding mass made of one or more electrochemically active materials, or the fibers coated with electrochemically active material may be embedded in an embedding mass made of the same or different electrochemically active material.

The fibers preferably are of substantial length, of the order of from a few centimeters up to the maximum electrode dimension, and they are substantially evenly distributed in the composite material, so that the composite material has a preferential direction that corresponds to the longitudinal fiber direction. Hence, the composite material has a particularly low electrical resistence in this preferential direction.

Due to the high electrical conductivity and the high strength, this composite material allows for departure from the massive type of construction as customarily employed so far for high temperature eletrodes. Rather, electrodes according to the invention are formed of a number of tubes, rods and/or plates, which tubes, rods or plates in their turn consist of the composite material and have a relatively small thickness. This type of construction, while reducing the amount of material required, ensures a considerably enlarged active electrode surface. For example, the tubes, rods and plates in their turn may be of a porous, perforated or mesh-like construction, from which a particularly large area for current transport between electrolyte and electrode results, which in turn reduces the local current density and increases the service life of the electrodes. The individual electrode elements can be manufactured with little effort by means of conventional molds, dies, tools and the like, and they may then be combined to the respectively required electrode configuration. In that way, the electrode according to the invention can in a particularly simple manner be adapted to the various kinds of fused salt electrolysis and makes possible many and varied high temperature applications.

The invention will be explained below in detail by way of preferred embodiments with reference to the drawings, which show in:

FIG. 1 a section of an electrode according to the invention consisting of a combination of thick-walled tubes. The inside of the tube is hollow and allows the entry or, respectively, exit of gases. Adjacent tubes are connected together on their outer walls, for example by a sintered contact.

FIG. 2 a section of an electrode according to the invention, which is formed of a number of hexagonal rods. Adjacent hexagonal rods are joined along parallel sides, so that a block, a row or some other kind of arrangement ensuring a large surface area is obtained. Passageways for a controlled gas direction can be provided by omitting certain hexagonal rods within the block.

FIG. 3 a section of an electrode according to the invention, which is formed of a combination of joined rods and tubes.

FIG. 4 a different type of electrode according to the invention, consisting of a combination of plates and thin-walled tube. The tubes hold the plates at a certain spacing; all of the electrode elements are cemented with one another along their contact surfaces.

FIG. 5 a further type of electrode according to the invention, consisting of a plate, from the main surface of which a number of rods project at right angles. The abutting end faces of the rods are connected with the main plate surface in an electrically conductive manner, so that plate ensures a uniform supply of current to the individual rods.

FIG. 6 a further type of electrode according to the invention, consisting of a combination of plates and rods. The plates which have the same dimensions are combined to form a stack with flush bores, into which the rods are inserted. The rods serve as holders and allow for the current supply to each individual plate.

FIG. 7 a sectional view of the arrangement of the fibers within a rod. As may be seen, the individual fibers, wires, fiber bundles or wire bundles are distributed uniformly across the cross-sectional surface and extend substantially parallel to the longitudinal axis of the rod. The individual fibers or the like are embedded into the electrochemically active material 12.

Figure 8:
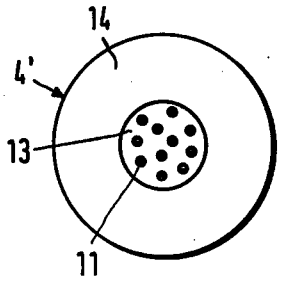

FIG. 8 a sectional view of a further rod, which includes a core zone and a sheath zone arranged concentrically relative thereto. Fibers, wires, fiber bundles or wire bundles, which extend substantially parallel to the longitudinal axis of the rod, are uniformly distributed over the cross-sectional surface of the core zone. The electrochemically active material surrounding the fibers or the like in the core zone differs from the electrochemically active material in the sheath zone, which is free of fibers or the like.

Figure 9:
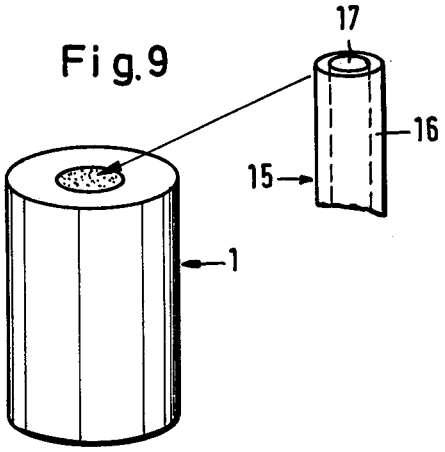

FIG. 9 a diagrammatic representation of an electrode according to the invention in the form of the thick-walled tube, the wall of which consists of electrochemically active material, within which coated chopped fibers are embedded. The coating on the fiber core may consist of an adhesion promoting intermediate layer or of an electrochemically active covering. The chopped fibers are distributed in random position within the embedding mass made of electrochemically active material.

Figure 10:
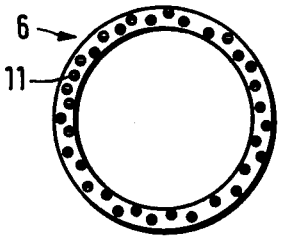

FIG. 10 a sectional view of a thin-walled tube. The tube wall consists of a composite material made of fibers and electrochemocally active material. The individual fibers, wires, fiber bundles or wire bundles are uniformly distributed over the cross-sectional surface of the tube wall and extend substantially parallel to the longitudinal tube axis.

Figure 11:
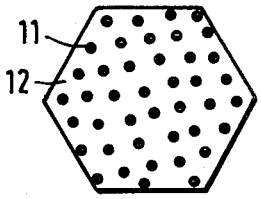

FIG. 11 the sectional view of a hexagonal rod that is built analogously to the round rod according to FIG. 7. The fibers or the like again extend parallel to the longitudinal rod axis and are embedded into the electrochemically active material.

Figure 12:
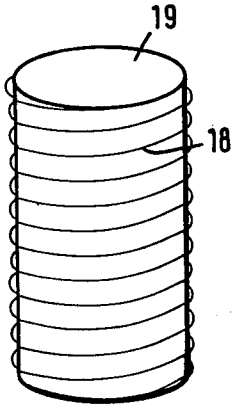

FIG. 12 a preliminary stage in the production of an electrode according to the invention in the form of a further embodiment of a thin-walled tube. In this case, a continuous fiber strand is wound in a continuously helical manner about a mandrel that can later be removed. Electrochemically active material is subsequently applied onto the surface of the mandrel, and the fiber strand windings are embedded therein. After the electrochemically active material has cured, the mandrel is removed.

The electrode elements of the electrodes according to the invention as shown and of further electrodes according to the invention consist of the material provided for according to the invention, namely a composite material made of inorganic fibers that well conduct the electric current and of at least one electrochemically active material.

Suitable fibers are commercially available, for example in the form of carbon fibers, such as they are sold by the Greatlakes Carbon Corporation under the trade designation "Fortafil"; these fibers (Fortafil 3 or 4) exhibit a tensile strength of 2.500 or 2.800 $N/mm^2$, a density of 1.73 or 1.80 $g/cm^3$ and a specific electrical resistence of 18 or 10Ω $mm^2/m$. Furthermore, the carbon fibers, or graphite fibers sold by C. Conradty Nürnberg GmbH & Co. KG under the trade designation "CECOTEX", which fibers are available for example in felt or cord form, are also suited; a Cecotex-cord of that kind exhibits a breaking load of 35 to 50 N, a density of 0.1 to 0.4 $g/cm^3$ and a specific electrical resistence of about 100 to 200Ω $mm^2/m$.

Suitable fiber materials usefully exhibit a melting or, respectively, softening point of between 2.300° and 3.600° C., a density of between 1.7 and 19 $g/cm^3$ and a bending strength of about 1.500 to 4.00 $N/mm^2$. Typical properties of fiber materials that are serviceable are set forth in the following table:

| Fiber material | Melting or softening temperature (°C.) | Density (g/cm³) | Modulus of elasticity (N/mm²) |
|---|---|---|---|
| boron/tungsten | 2300 | 2.70 | 400.000 |
| SiC/tungsten | 2700 | 3.50 | 450.000 |
| zirconium dioxide | 2700 | 4.84 | 350.000 |
| carbon | 3600 | 1.75 to 1.95 | 260.000 to 380.00 |
| carbon/boron/carbide | 3000 | 2.25 | 400.000 |
| SiC-whisker | 2690 | 3.21 | 500.000 |
| carbon-whisker | 4000 | 2.20 | 1,000.000 |

Suitable fiber materials may be present in monocrystalline, polycrystalline or amorphous form. Examples of monocrystalline fibers are the known whiskers, for example of silicon carbide (SiC) or of boron carbide ($B_4C$), which on account of their extraordinary strength values, besides the electrical conductivity, also serve as structure-supporting element or, respectively, framework material. Suitable polycrystalline fibers may be present in single-phase form ($ZrO_2$, $B_4C$) or in polyphase form (B/W, $B_4C$/W, SiC/W or $TiB_2$/W). Finally, the already mentioned carbon fibers are serviceable amorphous fibres.

Preferred fiber materials are chosen (C); boron (B) and/or silicon carbide (SiC); tantalum carbide (TaC) or tungsten carbide (WC); a mixture of carbon and non-stoichiometric tantalum carbide ($TaC_{x\ to\ 1}$); a mixture of non-stoichiometric tantalum carbide ($TaC_{x\ to\ 1}$) and non-stoichiometric niobium carbide ($NbC_{x\ to\ 1}$) and, finally, a mixture of non-stoichiometric tantalum carbide ($TaC_{x\ to\ 1}$), non-stoichiometric niobium carbide ($NbC_{x\ to\ 1}$) and carbon.

An exemplary process of producing suitable fibers is known from U.S. Pat. No. 3,403,008. According thereto, pre-shaped organic polymer is impregnated with metal halides having a hydrolysing effect, the impregnated material is converted under heating to the carbon stage, optionally with oxide inclusions, and the mixture obtained is, finally, converted to the corresponding metal carbide. In this manner, fibers, woven goods and the like made of uranium, tungsten, silicon, titanium, zirconium and boron carbide as well as of the mixtures thereof are obtained.

The fiber material may be present in the form of individual fibers, fiber strands, one or more wires, wire bundles, cords, felts, fabrics or as chopped fibers. Preferably fiber strands, wire bundles or cords are provided of such a length that the fibers or the wires extend without interruption from one end to the other end of the tubes and rods. A fabric or felt web may serve as a framework body to produce plates. The production of fibers and wires may take place according to customary methods, for example by melt spinning methods, extrusion methods or drawing methods, which may be followed by a thermal after-treatment. For example, the surface coatings may be subsequently vapor phase deposited, in which connection reaction processes with the fiber material may follow.

The composite material provided according to the invention contains one or more electrochemically active materials besides the fiber material. Electrochemically active materials are understood to be such, which ensure the chemical stability of the electrodes under the high-temperature conditions with respect to the electrolysis products and take care that there is good current transportation between fiber material and electrolyte, fused salt or the like. The electrochemically active material reduces over-voltage and optionally exhibits additional catalytic properties.

Suitable electrochemically active materials include metal carbides, metal borides, metal nitrides and/or elemental metal. In this connection, the electrochemically active material in its turn may consist of a mixture of a plurality of components and may as well be present on the fibers in the form of several layers of varying composition.

Preferred electrochemically active materials are represented by tantalum carbide, single or mixtures of several barium titanates and cermet-materials of two metals and one transition metal oxide. Suitable barium titanates are described in a report by J. G. Dickson, L. Katz and R. Word in J.A.C.S. 83, page 3026 (1961) and exhibit for example the following compositions:

$Ba(Pt_{0.1}Ti_{0.9})O_3$,
$Ba(Ru_{0.3}Ti_{0.7})O_3$,
$Ba(Pt_{0.2}Ti_{0.8})O_3$ or
$Ba(Pt_{0.25}Ti_{0.75})O_3$

Further electrochemically active components of this type are set forth in German OS 23 54 477.

Tantalum carbide is a particularly preferred electrochemically active material, especially as a coating on carbon fibers. Tantalum carbide is resistent in the high-temperature range against many metal melts and non-oxydizing salt melts, but it is, on the other hand, attacked by oxydizing salt and alkali melts. At temperatures of above 400° C., a very violent reaction takes place in air with oxygen; hence, it is advisable in connection with the use in electrochemical high-temperature processes to provide for a previous surface oxidation of the entire electrode.

The physical properties, the chemical stability and the electrochemical activity of tantalum carbide (TaC) can be influenced by a reduction in the carbon content, in which regard non-stoichiometric tantalum carbides ($TaC_{x\ to\ 1}$) of a composition between $Ta_2C$ (x=0.5) and TaC (x=1) are obtained, according to the fully occupied lattice. For example, the melting point of $TaC_{0.85}$ is above 4000° C. Non-stoichiometric tantalum carbides of that kind constitute a particularly preferred coating material.

For production, carbon fibers vapor-treated with tantalum or tantalum oxide or plasma-sprayed carbon fibres can be heated in vacuum or under protective gas to 1600° to 1900° C.; a reaction corresponding to n $Ta_2O_5$+m Ta+(7n+m) C→(2n+m) TaC+5nCO, takes place in that regard.

Conditions are similar in the case of the isotyped carbides of niobium, molybdenum and tungsten, which, therefore also constitute suitable coating materials, particularly for carbon fibers.

Cermet-materials consisting of a transition metal oxide and two different metals, in particular transition metals, are further particularly preferred elelctrochemically active materials. A cermet of nickel, silver and yttrium oxide or a cermet of nickel, palladium and yttrium oxide have proven to be particularly well serviceable. This kind of cermet-materials is especially suited for coating zirconium dioxide fibers.

Futhermore, a number of the ceramic materials, such as set forth in the patent publications mentioned at the outset, are also serviceable as electrochemically active materials within the scope of this invention; this applies for example for compounds of the type $SnO_2.Fe_2O_3$, $NiO.Fe_2O_3$ and $Zn.Fe_2O_3$, such as they are described in U.S. Pat. No. 4,057,480, or for ceramic materials of ytrrium oxide with at least one further electrically conductive oxide, such as described in South African Patent Application No. 77/1931; further, serviceable ceramic materials are described in French Patent Application No. 75.32 354.

The electrochemically active material provided for according to the invention protects the fiber material from aggressive media, which are encountered under electrolysis conditions, and it ensures current transportation between fiber material and electrolyte, salt melt or the like. In this connection, the electrochemically active material is as far as possible to cover the fiber material. Preferably at least 40% of the fiber surface is to be covered. A good surface covering of fibers, wires, fabrics or felts of inorganic material with ceramic material proves to be difficult in practice. Suggestions for solving this problem are made for example in a report in Ber.Dt.Keram.Ges. 55, page 265 (1978). It is suggested for example, in order to prevent filament breakage of SiC-coated carbon fibers, to immerse said fibers into silica esters and to hydrolize them in moist air. Gel-like $SiO_2$ is, however, formed by this method, which wets the fibers and uniformly infiltrates the fiber strands, so that a 100% fiber coverage can be arrived at. Furthermore, the use of intermediate layers, especially of titanium nitride (TiN) may be useful; fiber coverage of about 75% can be achieved; fiber coverage of about 50 to 80% of the fiber surface can be attained with partly oxidized SiC-fibers.

A further improvement of the electrodes according to the invention can be achieved by additionally embedding chemically and thermally stable carbides and/or nitrides into the surface of the electrode by means of adhesion promoters; for example, the carbides of boron, titanium, zirconium, niobium, tantalum, thorium as well as the nitrides of titanium, zirconium, niobium or borides of titanium and zirconium as well as oxides of zirconium or noble metals such as platinum, palladium and the like may be embedded into the electrochemically active material in order to match the electrochemical properties thereof to specific requirements.

Preferred combinations of fiber material and electrochemically active material are set forth below:

Carbon fibers having a tantalum carbide cover, which is again coated with tantalum that is superficially transformed to oxide:

carbon fibers having a tantalum carbide cover and a further cover layer of cermet-material, for example of platinum/tantalum oxide, platinum/tantalum carbide, platinum titanium diboride or similar cermet-materials, in which platinum is replaced by other metals selected from the platinum group; tungsten-carbide wires coated with boron or boron and silicon carbide (so-called borsic-filaments);

tantalum carbide nets coated with tantalum and tantalum oxide; titanium diboride wires or titanium carbide wires coated with tantalum carbide and tantalum oxide;

zirconium oxide wires coated with titanium boride; as well as zirconium dioxide fiber coated with a cermet-material consisting of nickel, silver and yttrium oxide, preferably a mixture of 40% yttrium oxide, 50% nickel and 10% silver.

The composite material provided for according to the invention may be obtained of the said fiber materials and electrochemically active material according to known processes. For example, the starting materials are brought to the desired shape of the tubes, rods or plates by means of cold-compression (strand, block or isostatic-compression), and these pre-shaped electrode elements are subsequently hot-sintered. Alternatively, the electrode elements can be produced directly by hot-isostatic-compression. Further details regarding the production can be gathered from the examples set forth below.

According to an alternative embodiment, tubes or rods are shaped from inorganic coated tungsten fabric, which tubes or rods then are treated in known manner under heat with $BCl_3$ or similar gaseous boron compounds for boriding. This may in a similar way also be done with an entire fabric-tube-bundle, fabric-rod-bundle or mat-bundle.

These fiber materials, which conduct electricity well and are, on account of their coating, resistent to attack by components from high temperature-electrolytic processes, are optionally covered by like or different electrochemically active components sintered therearound and are embedded therein.

The coating and/or the embedding composition, respectively made of electrochemically active material, is exposed to attack from the reactive components of the electrolysis operation. It has turned out in practice that it is advisable to again sinter around the active system of the electrode, namely the structure of fiber material primarily conducting the electrical current, after a period of operation of several years. This reactivates the electrode. The construction as according to the invention of the electrode involving a combination of tubes, rods, and/or plates allows for a particularly simple form of regeneration because all that is necessary is to apply fresh electrochemically active material on-to the frame work material and to sinter it thereon. The individual electrode elements, namely the tubes, rods or plates, can be combined in any desired manner to form bundles so as to prepare the finished electrode, which bundles in turn consist of the tubes, rods, plates or the combinations thereof. Coherence of the individual electrode elements among one another can be realized by way of a sintered connection, by cement that is applied or by any other kind of inorganic adhesive. Preferably, an electrically conducting connection is provided between the individual electrode elements in order to ensure uniform distribution of current within the entire electrode.

The following examples serve to further explain the invention without limiting it.

EXAMPLE 1

5 kg platinized carbon chopped fibers, 1 kg zinc oxide, 40 kg tin oxide and 4 kg phenolic resin are carefully blended, and the mixture obtained is extruded at room temperature into round rods, hexagonal rods or tubes. Due to extrusion, the short fibers are oriented in the pressing direction. The extruded bodies are held for some time at temperatures of up to a maximum of 250° C. in order to condensate the auxiliary bonding agent (phenolic resin) and to cure it. The pre-formed electrode elements are subsequently sintered for 18 hours at 1000° to 1100° C. If the electrode elements are maintained upon such sintering in an arrangement in which they contact one another, the electrode elements are sintered together to form the finished electrode.

EXAMPLE 2

A coating of non-stoichiometric tantalum carbide (of the approximate composition $TaC_{0.85}$) is applied, as stated above, on-to carbon fibers. The tantalum carbide coating is in part provided with a cover layer of platinum. 3 kg of these fibers are mixed with 2 kg of barium titanate (of the composition $Ba(Pt_{0.1}Ti_{0.9})O_3$), 19 kg tin oxide and 1 kg yttrium oxide. The entire batch of 25 kg is sinter-pressed at 1400° C. for 24 hours to form plates and rods.

EXAMPLE 3

0.1 kg boron fibers, 0.1 kg silicon carbide fibers, 3 kg tantalum powder and 0.3 kg phenolic resin are carefully blended, and the mixture obtained is pressed in cold-isostatic manner to form hexagonal rods. The rods obtained are moderately heated in order to condensate the phenolic resin and to cure it. Subsequently thereto, the rods are embedded in graphite powder and are heated for 24 hours to 1800° C. in a protective argon gas. A composite material having a tantalum carbide surface is obtained in this manner.

EXAMPLE 4

Rovings consisting of carbon fibers are processed by means of known measures (for example wet winding) to form a polydirectionally oriented skeleton, the preferred direction of electrical conductivity of which is in the longitudinal axis. The skeleton is stabilized with a mixture of pitch and sulfur and is wound in this form into a tube and is thereupon cured. An impregnating agent is applied on-to said tube by means of vacuum-pressure-impregnation. The impregnating agent consists of a slurry of furfuryl alcohol/phenolic-resin/zirconium dioxide and palladium powder in the impregnation liquid (with a zirconium dioxide proportion of 30% and a palladium proportion of 10%). Subsequently thereto, thermal curing takes place at moderately high temperatures and, thereafter, high temperature sintering is carried out over 24 hours in a vacuum-induction furnace at 1800° C.

EXAMPLE 5

30 kg tin oxide ($SnO_2$), 7 kg yttrium oxide ($Y_2O_3$), 5 kg manganese dioxide ($MnO_2$) and 2 kg bismuth oxide ($Bi_2O_3$) are introduced into a ball mill and wet grinding is carried out for 100 minutes. A dross with viscosity of about 0.2 to 1.0 poises (at 20° C.) is obtained. 5 kg silvered carbon fibers are subsequently stirred into said dross and the entire slurry is dried at 110° C. The mass obtained is again comminuted, ground, screened and is, after an additional introduction of silvered carbon fibers, hot-isostatically pressed in the center of the pressing mould for 24 hours at 1400° C. to form electrode elements. A sintered body of good centric electrical conductivity in the longitudinal direction is obtained by this means, the outer portions of which are also penetrated by silvered carbon fibers.

EXAMPLE 6

30 kg tin oxide ($SnO_2$), 3 kg silver oxide ($Ag_2O$), 3 kg ruthenium oxide ($RuO_2$) and 4 kg cobalt oxide ($Co_2O_3$) are blended by dispersion using the circulatory method at 8000 rpm, and the mixture obtained is subsequently wet-ground for 100 minutes in a ball mill. The resultant slurry is thermally thickened until the viscosity of the dross of 2.5 to 4.5 poises (at 20° C.) has been attained. The composition is thereupon spray-dried (at about 390°–410° C.). Granulate particles having an average particle size of about 0.1 to 0.3 mm are obtained in that respect. This granulate is hot-isostatically sintered under pressure onto a blend-fabric of metallic conductive fibers, such as silvered carbon fibers that are provided with a ruthenium oxide coating, in order to obtain corresponding electrode elements.

EXAMPLE 7

Zirconium dioxide fibers having a melting and softening point of about 2700° C., a density of 4.84 g/cm$^3$ and a modulus of elasticity of 350 000 N/mm$^2$ are blended with a powdery cermet-material consisting of 40% yttrium oxide, 50% nickel and 10% silver (hence, a substance combination $(Y_2O_3)_{0.4}(Ni)_{0.5}(Ag)_{0.1}$), and tubes, rods or plates are produced from said mixture by means of cold pressing (strand pressing, block pressing or isopressing). These electrode elements are subsequently hot-sintered; for example, rods having a diameter of 10 mm are produced.

A bundle of such rods was sintered together to form an electrode, and the electrode obtained was utilized in fused salt electrolysis processes; for example immersed into a melt of 32% $AlCl_3$, 35% NaCl and 33% $BaCO_3$ at a bath temperature of between 690° and 720° C., or immersed into a melt of 42% $MgCl_2$, 33% KCl and 25% NaCl at a bath temperature of between 650° and 700° C. Electrolysis was carried through at a current density of 0.75 A/cm$^2$. No measurable wear could be determined on the electrode after a duration of electrolysis of 100 days.

EXAMPLE 8

Carbon fibers provided with a nickel layer were embedded into an electrochemically active cermet-material consisting of 70% yttrium oxide, 45% nickel and 5% palladium, and this composite material was shaped into electrode elements. A bundle of these electrode elements was combined to form an electrode, and said electrode immersed into a melt consisting of 89% $Na_3AlF_6$, 5% $AlF_3$, 6% $Al_2O_3$, or into a melt consisting of 88% $Na_3AlF_6$, 5% $AlF_3$, 6% $Al_2O_3$ and 1% $LiCl_3$. Fused salt electrolysis was carried out at a current density of 0.75 A/cm$^2$. After 120 days of electrolysis, no measurable wear could be detected on the electrode.

EXAMPLE 9

The wear in various electrolytes under fused salt electrolysis conditions was tested with a number of electrodes according to the invention. The electrodes consisted of the following composite materials:

(a) carbon fibers having a base layer of tantalum carbide, an intermediate layer of metallic tantalum and a cover layer of tantalum oxide;

(b) carbon fibers having a base layer of metallic platinum and a cover layer of titanium carbide;

(c) boron-silicon carbide fibers having a base layer of metallic platinum and a cover layer of $Ba(Pt_{0.2}Ti_{0.8})O_3$; and (d) zirconium oxide fibers having a cover layer of tantalum oxide with $Ta_2WO_8$.

Electrodes having the following configurations were shaped of these composite materials:

(1) Electrodes made of a combined tube bundle; each tube had a tube diameter of 1 cm at an inside width of 0.2 cm. Contacting took place with platinum wires or platinized iron;

(2) Electrodes of round rods combined to form a bundle; each rod has a diameter of 1 cm; contacting took place with platinized iron; and (3) fiber material mats stitched together and having a mat thickness of 1 cm; contacting took place by means of platinum.

Fused salt electrolysis was carried through in electrolytes of the following composition:

(A) 89% $Na_3AlF_6$, 5% $AlF_3$, 6% $Al_2O_3$ at a bath temperature of 880° to 960° C.;

(B) 32% $AlCl_3$, 35% NaCl, 33% $BaCO_3$ at a bath temperature of 690° to 720° C.;

(C) 39% $MgCl_2$, 61% KCl at a bath temperature of 650° to 700° C.;

(D) 42% $MgCl_2$, 33% KCl, 25% NaCl at a bath temperature of 650° to 700° C.; and (E) an electrolyte of initially one part $CeCl_2$ to one part $CaCl_2$, the composition of which was changed stepwise to four parts $CeCl_2$ to one part $CaCl_2$; the bath temperature was 800° to 950° C.

As for detail, the melts were produced in electrolysis cells of hard graphite crucibles having a capacity of about 4 kg, which were heated indirectly or by means of the direct current passage. The carbon-graphite-material of the crucible served as cathode. In that way, electrode conditions were ensured such as they exist today in highly loaded electrolysis cells. The rim of the crucible was protected by a fritted mixture of highly-sintered, highly pure $Al_2O_3$ in order prevent uncontrolled reverse reactions. The respective electrode (diameter of 5 cm) was immersed into the melt down to a depth of 10 cm. Electrolysis took place at current densities of between 0.5 and 1 A/cm$^2$. After a duration of electrolysis of 250 hours, the wear as set forth in the table below was determined on the individual electrodes.

| Electrode | Melt | Wear (g/100 h) |
|---|---|---|
| 1a | A | 0.12 |
| 1a | C | 0.06 |
| 1a | E | 0.08 |
| 1b | A | 0.09 |
| 1a | B | 0.05 |
| 2c | A | 0.09 |
| 2c | B | 0.05 |
| 2a | B | 0.10 |
| 3b | E | 0.12 |
| 3a | E | 0.12 |

As can be seen, the wear of these electrodes as according to the invention is at about 0.1 g/100 h duration of electrolysis. Further wear rates of about 0.05 to 0.20 g/100 h duration of electrolysis were found for a further group of electrodes according to the invention. Hence, the electrodes according to the invention exhibit a substantially lower wear than that of known electrodes because the wear rate for the electrodes known so far is at about 0.7 to 10 g/100 h duration of electrolysis.

The electrodes according to the invention exhibit a substantially reduced internal resistence compared to known sintered electrodes made of massive ceramic. This is due to the minimum paths of current conduction from the current conduction fiber core to the electrochemically active surface, and to the substantially enlarged electrochemically active surface area on account of the porous structure of the composite material. As a result, the electrodes according to the invention exhibit substantially higher resistance to continuous stress and higher stability compared to electrochemical and chemical attacks at the bonding agents.

Finally, the stability of the electrodes according to the invention compared to the known strong attacks when current is cut off has been considerably increased. Whereas destruction frequently occurs, as is known, in connection with $SnO_2$-electrodes by alumino-thermal reaction when the current is cut off, similar phenomena were not observed in any instance with the electrodes as according to the invention.

We claim:

1. A regeneratable, non-consumable electrode for high temperature uses, in particular for fused salt electrolyses, comprising a number of electrically conductive interconnected electrode elements shaped as tubes, rods or plates, which respectively have a preferential direction coinciding with the direction of the electric current, each electrode element comprising a plurality of inorganic fibers for conducting the electric current, at least one solid and continuous electrochemically active material extending between said fibers so that said fibers are solidly and rigidly embedded in said at least one solid and continuous electrochemically active material, and wherein said fibers are arranged so that the fiber longitudinal orientation coincides essentially with the direction of current conduction within the electrode elements.

2. Electrode according to claim 1 characterized in that the inorganic fibers are coated fibers, the coating thereof comprising solid electrochemically active material.

3. Electrode according to claim 2, characterized in that the coating comprises at least two layers.

4. Electrode according to claim 1, characterized in that an adhesion-promoting intermediate layer is disposed on the inorganic fibers thereby improving the adherence of the fibers to the electrochemically active embedding material.

5. Electrode according to claim 2, characterized in that an adhesion-promoting intermediate layer is disposed on the inorganic fibers thereby improving the adhesion of the fiber to the electrochemically active coating material.

6. Electrode according to claim 1, characterized in that at least 40% of the fiber surface is in contact with the electrochemically active embedding material.

7. Electrode according to claim 2, characterized in that at least 40% of the fiber surface is in contact with the electrochemically active coating material.

8. Electrode according to claim 1, characterized in that the fiber comprises at least one material selected from the class consisting of carbon, boron and silicon carbide.

9. Electrode according to claim 1, characterized in that the fiber comprises a mixture of carbon and a non-stoichiometric tantalum carbide ($TaC_{1-x}$) where x is at most 0.5.

10. Electrode according to claim 2 characterized in that the fiber coating material comprises at least one member of the class consisting of a metal carbide, a metal boride, a metal nitride, and elemental metal.

11. Electrode according to claim 8, characterized in that the fiber coating material comprises at least one member of the class consisting of tantalum, tantalum carbide and tantalum oxide.

12. Electrode according to claim 1, characterized in that the electrochemically active embedding material comprises at least one barium titanate of the composition $Ba(M_xTi_{1-x})O_3$ whereby M represents Pt, Pd or Ru, and x fulfills the condition $0.1 \leqq x \leqq 0.5$.

13. Electrode according to claim 1, characterized in that the electrochemically active embedding material is a cermet comprising two different elemental metals and a transition metal oxide.

14. Electrode according to claim 13, characterized in that the electrochemically active embedding material is a cermet comprising nickel, silver and yttrium oxide.

15. Electrode according to claim 13, characterized in that the electrochemically active embedding material is a cermet comprising of nickel, palladium and yttrium oxide.

16. Electrode according to claim 1, characterized in that the fibers are embedded in the form of fiber bundles.

17. Electrode according to claim 1, characterized in that the fibers extend continuously from one end to the other end of the electrode elements in the direction of current conduction therein.

18. Electrode according to claim 1, characterized in that the fibers are formed into cords, fabrics or felts, which cords, fabrics or felts are rigidly and solidly embedded in the electrochemically active material.

19. Electrode according to claim 1, characterized in that the electrode elements are interconnected by inorganic, electrically conductive binding agents.

20. A regeneratable, nonconsumable electrode for high temperature uses, in particular for fused salt electrolyses, comprising a self-sustaining, rigid body having a number of electrically conductive interconnected electrode elements shaped as tubes, rods or plates, which respectively have a preferential direction coinciding with the direction of the electric current, each electrode element comprising a plurality of inorganic fibers, for conduction the electric current, at least one solid and continuous electrochemically active material extending between said fibers so that said fibers are solidly and rigidly embedded in said at least one solid and continuous electrochemically active material, and wherein said fibers are being so that the fiber longitudinal orientation coincides essentially with the direction of current conduction within the electrode elements.

* * * * *

UNITED STATES PATENT OFFICE

CERTIFICATE OF CORRECTION

Patent No. 4,456,519 Dated June 26, 1984

Inventor(s) Dieter H. Zollner et al

It is certified that error appears in the above-identified patent and that said Letters Patent are hereby corrected as shown below:

Column 5, line 26 delete "fibres" insert --fibers--.

Column 5, line 27 delete "chosen" insert --carbon--.

Column 6, line 49 delete "fibres" insert --fibers--.

Column 6, line 55 after "therefore" insert --,--.

Column 6, line 59 delete "elelctrochemically" insert --electrochemically--.

Column 11, line 63 delete "conduction" insert --conducting--.

Column 13, line 12 delete "of".

Column 14, line 2 after "the" insert --solid--.

Column 14, line 19 delete "being" insert --arranged--.

Signed and Sealed this

*Twentieth* Day of *August 1985*

[SEAL]

*Attest:*

DONALD J. QUIGG

*Attesting Officer* *Acting Commissioner of Patents and Trademarks*